US008588626B2

(12) United States Patent
Inoue et al.

(10) Patent No.: US 8,588,626 B2
(45) **Date of Patent: *Nov. 19, 2013**

(54) APPARATUS AND OUTPUT SETTING METHOD OF CONSUMED STATUS OF CONSUMABLE ITEMS OF THE APPARATUS

(71) Applicants: Yoshiya Inoue, Kanagawa (JP); Yasuyuki Igarashi, Kanagawa (JP); Takeshi Fujita, Tokyo (JP); Yuka Saito, Kanagawa (JP); Toshio Kitazawa, Chiba (JP)

(72) Inventors: Yoshiya Inoue, Kanagawa (JP); Yasuyuki Igarashi, Kanagawa (JP); Takeshi Fujita, Tokyo (JP); Yuka Saito, Kanagawa (JP); Toshio Kitazawa, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/751,952

(22) Filed: Jan. 28, 2013

(65) Prior Publication Data

US 2013/0136463 A1 May 30, 2013

Related U.S. Application Data

(63) Continuation of application No. 13/588,673, filed on Aug. 17, 2012, now Pat. No. 8,391,731, which is a continuation of application No. 13/270,272, filed on Oct. 11, 2011, now Pat. No. 8,270,854, which is a continuation of application No. 12/979,721, filed on Dec. 28, 2010, now Pat. No. 8,064,784, which is a continuation of application No. 12/683,199, filed on Jan. 6, 2010, now Pat. No. 7,890,001, which is a continuation of application No. 11/619,359, filed on Jan. 3, 2007, now Pat. No. 7,672,601.

(30) Foreign Application Priority Data

Jan. 17, 2006 (JP) ..... 2006-009259

(51) Int. Cl.
*G03G 15/00* (2006.01)
*G03G 15/08* (2006.01)

(52) U.S. Cl.
USPC ..... 399/24; 399/26; 399/27; 399/81

(58) Field of Classification Search
USPC ..... 399/26, 24, 27, 81
See application file for complete search history.

(56) References Cited

U.S. PATENT DOCUMENTS 5,557,707 A 9/1996 Inoue et al.
5,797,061 A 8/1998 Overall et al.

(Continued)

FOREIGN PATENT DOCUMENTS

JP 4-101171 4/1992
JP 08328365 A 12/1996

(Continued)

OTHER PUBLICATIONS

Office Action issued May 24, 2011 in Japan Patent Application No. 2006-009259.

*Primary Examiner* — Susan Lee
(74) *Attorney, Agent, or Firm* — Oblon, Spivak, McClelland, Maier & Neustadt, L.L.P.

(57) ABSTRACT

An apparatus that uses plural kinds of consumable items different from each other, the apparatus including a consumption status detecting device to detect a respective consumption status for each of the plural kinds of the consumable items, a memory to store a plurality of settings for each of the plural kinds of the consumable items, each of the settings including presence or non-presence of information output, and an output device to output the consumption status detected by the consumption status detecting unit, according to the setting of the presence or the non-presence of information output stored in the memory.

14 Claims, 18 Drawing Sheets

(56) References Cited

U.S. PATENT DOCUMENTS

| | | | | |
|---|---|---|---|---|
| 5,797,067 | A | 8/1998 | Mitekura | |
| 6,347,198 | B1 | 2/2002 | Yamamoto et al. | |
| 6,456,802 | B1 | 9/2002 | Phillips | |
| 6,748,183 | B2 | 6/2004 | Edmonds | |
| 7,206,524 | B2 | 4/2007 | Yokoe | |
| 7,230,731 | B2 | 6/2007 | Dan et al. | |
| 7,302,198 | B2 | 11/2007 | Ahn | |
| 7,362,464 | B2 | 4/2008 | Kitazawa | |
| 7,477,854 | B2 | 1/2009 | Nakazawa et al. | |
| 7,593,652 | B2 | 9/2009 | Takahashi et al. | |
| 7,672,601 | B2 | 3/2010 | Inoue et al. | |
| 7,890,001 | B2 | 2/2011 | Inoue et al. | |
| 8,270,854 | B2 * | 9/2012 | Inoue et al. | 399/81 |
| 8,391,731 | B2 * | 3/2013 | Inoue et al. | 399/24 |
| 2003/0161002 | A1 | 8/2003 | Nishiwaki et al. | |
| 2004/0136016 | A1 * | 7/2004 | Oshikawa et al. | |
| 2004/0168116 | A1 | 8/2004 | Shikata | |
| 2005/0260002 | A1 * | 11/2005 | Masui | |
| 2005/0279821 | A1 | 12/2005 | Otsuka et al. | |
| 2006/0204250 | A1 | 9/2006 | Ishihara et al. | |
| 2006/0222382 | A1 | 10/2006 | Gady et al. | |

FOREIGN PATENT DOCUMENTS

| | | |
|---|---|---|
| JP | 2001-256029 | 9/2001 |
| JP | 2002-268476 | 9/2002 |
| JP | 2003-280865 | 10/2003 |
| JP | 2004-192151 | 7/2004 |
| JP | 2005-84611 | 3/2005 |
| JP | 2005-202045 | 7/2005 |

* cited by examiner

FIG.6

| CONSUMABLE ITEM | OUTPUT CONTENTS | |
|---|---|---|
| | CONSUMED STATUS | EXCHANGE MESSAGE |
| PHOTOCONDUCTOR BODY | PRESENCE | NON-PRESENCE |
| TONER | PRESENCE | PRESENCE |

FIG.7

| CONSUMABLE ITEM | OUTPUT CONTENTS | | |
|---|---|---|---|
| | CONSUMED STATUS | EXCHANGE MESSAGE 1 | EXCHANGE MESSAGE 2 |
| PHOTOCONDUCTOR BODY | PRESENCE | PRESENCE | NON-PRESENCE |
| TONER | PRESENCE | PRESENCE | PRESENCE |

FIG.8

| COMBINATION NAME | OUTPUT CONTENTS | | |
|---|---|---|---|
| | CONSUMED STATUS | EXCHANGE MESSAGE 1 | EXCHANGE MESSAGE 2 |
| A | PRESENCE | PRESENCE | PRESENCE |
| B | PRESENCE | PRESENCE | NON-PRESENCE |
| C | NON-PRESENCE | PRESENCE | PRESENCE |
| D | NON-PRESENCE | PRESENCE | NON-PRESENCE |

(a)

| CONSUMABLE ITEM | COMBINATION NAME |
|---|---|
| PHOTOCONDUCTOR BODY | B |
| TONER | A |

(b)

| CONSUMABLE ITEM | COMBINATION NAME |
|---|---|
| PHOTOCONDUCTOR BODY | D |
| TONER | A |

(c)

| CONSUMABLE ITEM | COMBINATION NAME |
|---|---|
| PHOTOCONDUCTOR BODY | D |
| TONER | D |

FIG.10

| CONSUMED STATUS | EXCHANGE MESSAGE 1 | EXCHANGE MESSAGE 2 |
|---|---|---|
| PRESENCE | PRESENCE | NON-PRESENCE |

FIG.17

| CONSUMABLE ITEMS | COLOR | REMAINING AMOUNT INFORMATION |
|---|---|---|
| TONER | BLACK & COLOR, OR<br>BLACK, YELLOW, CYAN, AND MAGENTA | AT 10% INTERVALS OR 20% INTERVALS |
| WASTE TONER BOTTLE | — | SOME VACANCIES, NEAR END, OR FULL |
| DEVELOPING UNIT | BLACK & COLOR | AT 10% INTERVALS OR 20% INTERVALS |
| TRANSFER UNIT | — | AT 10% INTERVALS OR 20% INTERVALS |
| INTERMEDIATE TRANSFER UNIT | — | AT 10% INTERVALS OR 20% INTERVALS |
| FIXING/SECONDARY TRANSFER UNIT | — | AT 10% INTERVALS OR 20% INTERVALS |
| FIXING UNIT | — | AT 10% INTERVALS OR 20% INTERVALS |
| FIXING OIL UNIT | — | AT 10% INTERVALS OR 20% INTERVALS |

REMARKS: AT NEAR END OR END, LETTER STRING OF NEAR END OR END IS SHOWN INSTEAD OF BAR EXPRESSION AT 10% INTERVALS OR 20% INTERVALS

APPARATUS AND OUTPUT SETTING METHOD OF CONSUMED STATUS OF CONSUMABLE ITEMS OF THE APPARATUS

CROSS-REFERENCE TO RELATED APPLICATIONS

This application is a continuation application of 13/588,673, filed Aug. 17, 2012, which is a continuation application of 13/270,272, filed Oct. 11, 2011, now U.S. Pat. No. 8,270,854 which is a continuation application of 12/979,721, filed Dec. 28, 2010, now U.S. Pat. No. 8,064,784, which is a continuation application of 12/683,199, filed Jan. 6, 2010, now U.S. Pat. No. 7,890,001, which is a continuation of and claims the benefit of priority under 35 U.S.C. §120 from U.S. application Ser. No. 11/619,359, filed Jan. 3, 2007, now U.S. Pat. No. 7,672,601, which is based on Japanese Priority Patent Application No. 2006-009259, filed on Jan. 17, 2006, with the Japanese Patent Office. The entire contents of the above applications are incorporated herein by reference.

BACKGROUND OF THE INVENTION

1. Field of the Invention

The present invention generally relates to an apparatus and an output setting method of the consumed status of consumable items of the apparatus.

2. Description of the Related Art

Conventionally, there is an image forming apparatus which outputs the consumed status of a consumable item and a message for exchanging the consumable item. The consumed status and the message of the consumable item are displayed on an operating panel of the image forming apparatus, on a screen of a computer connected to the image forming apparatus via a network by using a HTTP protocol, or are printed on a recording medium such as a paper by a printer engine of the image forming apparatus.

In addition, as a maintenance system of the image forming apparatus, there is a system in which a seller or a manufacturer of the image forming apparatus maintains performance and output quality of the apparatus and exchanges a consumable item for achieving the performance and for maintaining the output quality. In the following description, the above maintenance system is referred to as a performance maintenance system, a person who maintains the apparatus is referred to as a manager, and a person who uses the apparatus is referred to as a user.

When a consumable item is used up, not only can an image forming process not be executed but also this may cause a breakdown of the apparatus. Therefore, messages on the consumed status of a consumable item and on an exchange of the consumable item must be suitably output. In several cases, the messages on the consumed status of the consumable item and on the exchange of the consumable item which messages are important to maintain the performance of the apparatus are output with higher priority than a message on an error of software, for example, application software.

In Patent Document 1, a consumable item managing method is disclosed. In the method, an apparatus of a user side informs a managing apparatus of a manager side about the consumed status of a consumable item. With this, the manger side can supply the consumable item to the user side based on an agreement between the user and the manager.

In Patent Document 2, an image forming apparatus and a managing method thereof are disclosed. In the apparatus, output timing of messages concerning the status of the apparatus, the consumed status of a consumable item, and the exchange of the consumable item is managed based on the following information items. That is, the information items are a used period of the apparatus, a remaining amount of the consumable item, an exchanged history of the consumable item, and a printed history on a recording medium.

[Patent Document 1] Japanese Laid-Open Patent Application No. 2003-280865

[Patent Document 2] Japanese Laid-Open Patent Application No. 2005-84611

However, in Patent Documents 1 and 2, when the apparatus is manufactured, output contents and an output I/F (interface) are determined. Therefore, when the same I/Fs are used in the apparatuses of the user and the manager, the user and the manager obtain the same contents. In the performance maintenance system, when the user does not exchange a consumable item, that is, the manager exchanges the consumable item, a message to request the exchange of the consumable item is displayed on the operating panel of the user. That is, not only is a message unnecessary to the user displayed but also the unnecessary message is output with higher priority than a message on an error of software which message is more important for the user.

SUMMARY OF THE INVENTION

In a preferred embodiment of the present invention, there is provided an apparatus and an output setting method of the consumed status of consumable items of the apparatus in which output messages on the consumed status of a consumable item and on an exchange of the consumable item can be suitably set by the manager or the user.

Features and advantages of the present invention are set forth in the description that follows, and in part will become apparent from the description and the accompanying drawings, or may be learned by practice of the invention according to the teachings provided in the description. Features and advantages of the present invention will be realized and attained by an apparatus and an output setting method of the consumed status of consumable items of the apparatus particularly pointed out in the specification in such full, clear, concise, and exact terms as to enable a person having ordinary skill in the art to practice the invention.

To achieve one or more of these and other advantages, according to one aspect of the present invention, there is provided an apparatus which uses a consumable item. The apparatus includes a consumed status detecting unit which detects a value of the consumed status of the consumable item, a determining unit which determines to output an exchange message of the consumable item by comparing the value of the consumed status of the consumable item detected by the consumed status detecting unit with a predetermined value, an exchange message output setting unit which sets presence or non-presence of an output of the exchange message, and a consumed status output setting unit which sets presence or non-presence of an output of the consumed status of the consumable item detected by the consumed status detecting unit.

According to another aspect of the present invention, there is provided an output setting method of the consumed status of a consumable item of an apparatus. The output setting method includes the steps of detecting a value of the consumed status of the consumable item, determining whether to output an exchange message of the consumable item by comparing the detected value of the consumed status of the consumable item with a predetermined value, setting presence or non-presence of an output of the exchange message, and setting presence or non-presence of an output of the detected consumed status of the consumable item.

Effect of the Invention

According to an embodiment of the present invention, an apparatus can be obtained in which apparatus a manager or a user of the apparatus can easily set an output of the consumed status of each consumable item and can easily set a message concerning an exchange of each consumable item.

BRIEF DESCRIPTION OF THE DRAWINGS

Features and advantages of the present invention will become more apparent from the following detailed description when read in conjunction with the accompanying drawings, in which:

FIG. 6 is the output setting table in a case where there is a single exchange message;

FIG. 7 is an output setting table in a case where there are plural exchange messages;

FIG. 8 is a table showing combinations of output contents in the output setting table;

FIG. 10 shows examples of the plural consumable-item output setting tables;

FIG. 17 is a table in which remaining amount information of each consumable item is shown.

DESCRIPTION OF THE PREFERRED EMBODIMENT

Best Mode of Carrying Out the Invention

The best mode of carrying out the present invention is described with reference to the accompanying drawings.

In an embodiment of the present invention, as an image forming apparatus, a color laser printer is described, and as consumable items of the printer, a photoconductor body and toner are described. However, the embodiment of the present invention can be applied to other image forming apparatuses such as a copying machine and a facsimile apparatus. In addition, as the consumable items, other consumable items such as a developing unit, a transfer unit, and a fixing unit can be used.

Figure 1:
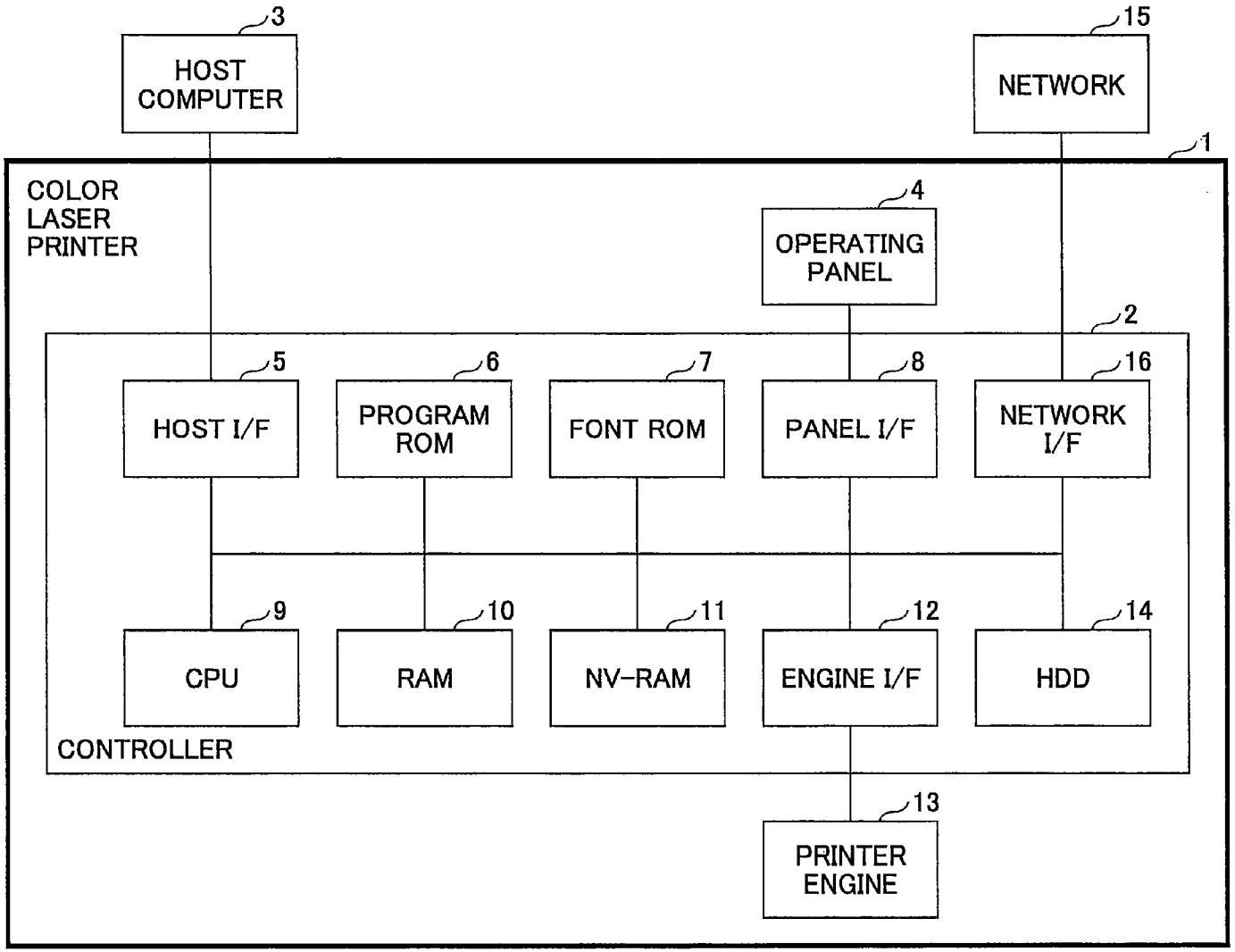
FIG. 1 is a block diagram showing a color laser printer according to an embodiment of the present invention.

FIG. 1 is a block diagram showing a color laser printer according to the embodiment of the present invention.

As shown in FIG. 1, a color laser printer 1 includes a controller 2, an operating panel 4, and a printer engine 13. The color laser printer 1 is connected to a host computer 3 and a network 15.

The controller 2 controls all the elements in the color laser printer 1 and includes a host I/F 5, a program ROM 6, a font ROM 7, a panel I/F 8, a CPU 9, a RAM 10, an NV-RAM (non-volatile RAM) 11, an engine I/F 12, an HDD 14, and a network I/F 16. The controller 2 can further include an additional RAM (not shown).

A manager or a user inputs several settings on the operating panel 4. In addition, several operations of the color laser printer 1 are displayed on the operating panel 4.

The printer engine 13 outputs control signals and print data from the controller 2 onto a recording medium (paper).

The host computer 3 transmits control signals and print data to the color laser printer 1, and processes signals to perform the several operations of the color laser printer 1.

One or more computers (not shown) are connected to the network 15, and print data and control signals from the computers are transmitted to the color laser printer 1 via the network 15. The computers receive output signals of the several operations of the color laser printer 1 via the network 15.

The host computer 3 transmits the control signals and the print data to the color laser printer 1 via the host I/F 5. The color laser printer 1 outputs signals of the several operations of the color laser printer 1 to the host computer 3 via the host I/F 5.

In the program ROM 6, programs are stored in which programs a data processing method and a data managing method in the controller 2 and a module controlling method of modules (not shown) in the color laser printer 1 are described.

In the font ROM 7, various fonts which are used for printing are stored.

The controller 2 is connected to the operating panel 4 via the panel I/F 8, and the panel I/F 8 receives signals input from the operating panel 4 and outputs the signals of the several operations of the color laser printer 1 to the operating panel 4.

The CPU 9 executes data processing in the color laser printer 1, data processing between the color laser printer 1 and external apparatuses, and controls the processes by using the programs stored in the program ROM 6.

In the RAM 10, data processed by the CPU 9, print data, and image data which the print data are converted into are temporarily stored.

The NV-RAM 11 stores data even if a power source of the color laser printer 1 is turned off.

The controller 2 is connected to the printer engine 13 via the engine I/F 12. The engine I/F 12 outputs print data and control signals output from the controller 2 to the printer engine 13, and receives control signals output from the printer engine 13.

The printer engine 13 executes a printing process by using the print data and the control signals received from the controller 2.

The HDD 14 stores, for example, print data when the print data are large.

The controller 2 is connected to the network 15 via the network I/F 16. The network I/F 16 receives print data and control signals from the computer (not shown) connected to the network 15 and transmits signals of several operations of the color laser printer 1 to the computer.

Data Receiving Process

The print data and the control signals are input to the color laser printer 1 from the host computer 3 via the host I/F 5, or from the computer (not shown) connected to the network 15 via the network I/F 16, and are separated into letter print data, letter print control data and so on. The separated data are stored in a buffer (not shown) in the RAM 10.

Image Data Forming Process

The CPU 9 executes programs stored in the program ROM 6 one by one. With this, the data stored in the buffer are taken out element by element and are processed. For example, from the letter print data, an intermediate code is generated which code provides a letter print position, a letter print size, a letter code, and font information. The generated intermediate code is stored in an intermediate buffer (not shown). A predetermined process is applied to the letter print control data, and the processed data are stored in an intermediate buffer. The definitions of the processes are described in the program stored in the program ROM 6.

When the amount of the processed data becomes an image forming amount of one page, or a print command is received from the computer which transmits the print data, the data stored in the intermediate buffer are converted into image data.

Image Data Outputting Process

The controller 2 transmits a print start command and the image data synchronized with the print start command to the printer engine 13 via the engine I/F 12.

Electrophotographic Process

Figure 2:
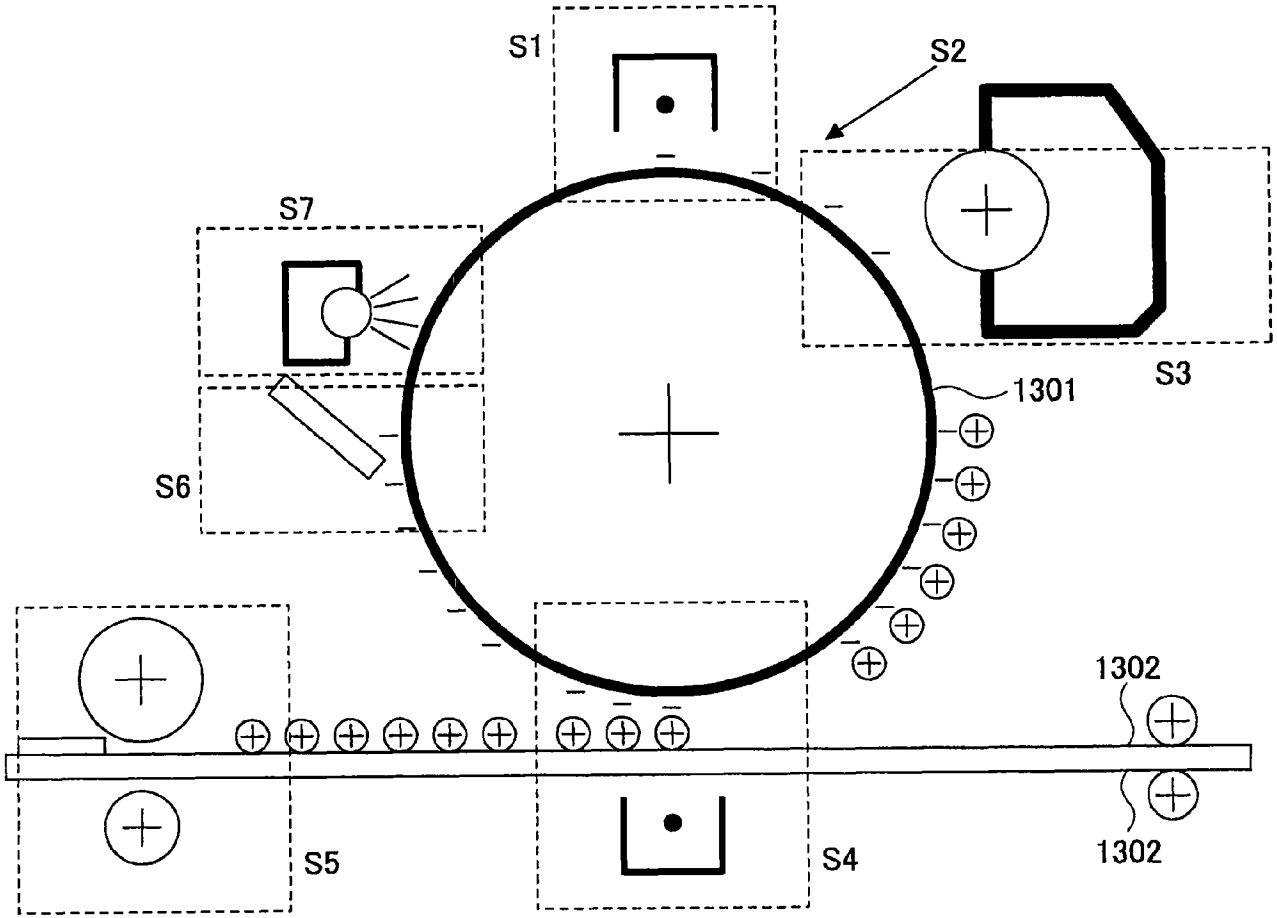
FIG. 2 is a diagram showing a flow of an electrophotographic process in a printer engine shown in FIG. 1.
Figure 3:
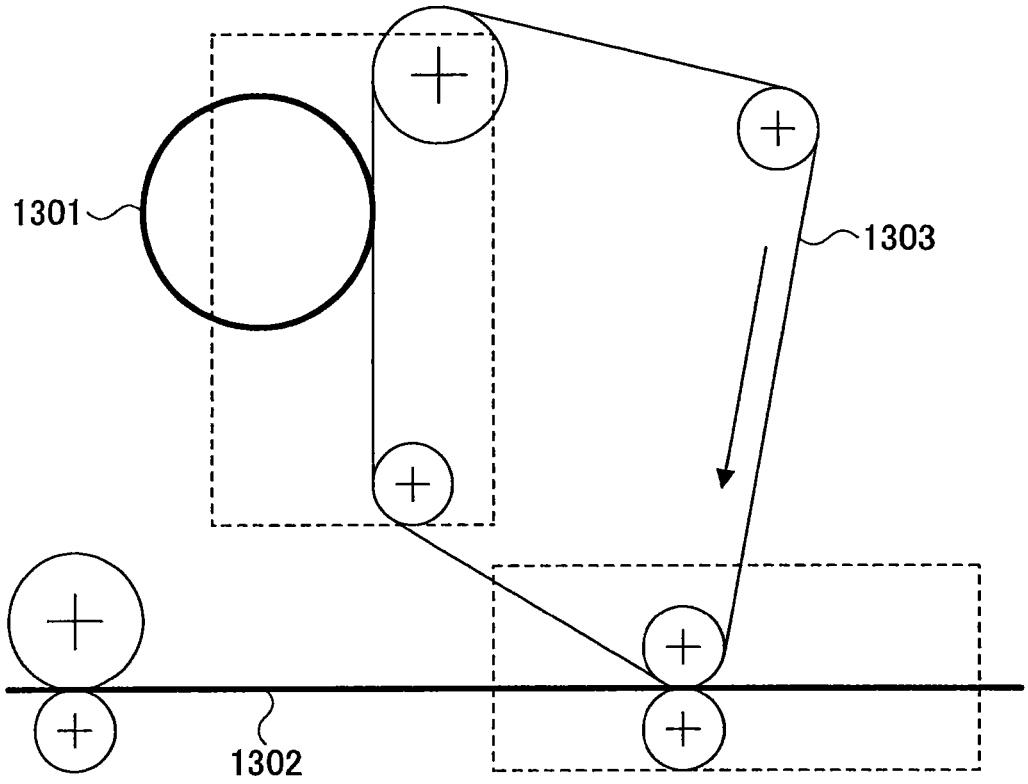
FIG. 3 is a diagram in which an intermediate transfer belt is used in the electrophotographic process shown in FIG. 2.
Figure 4:
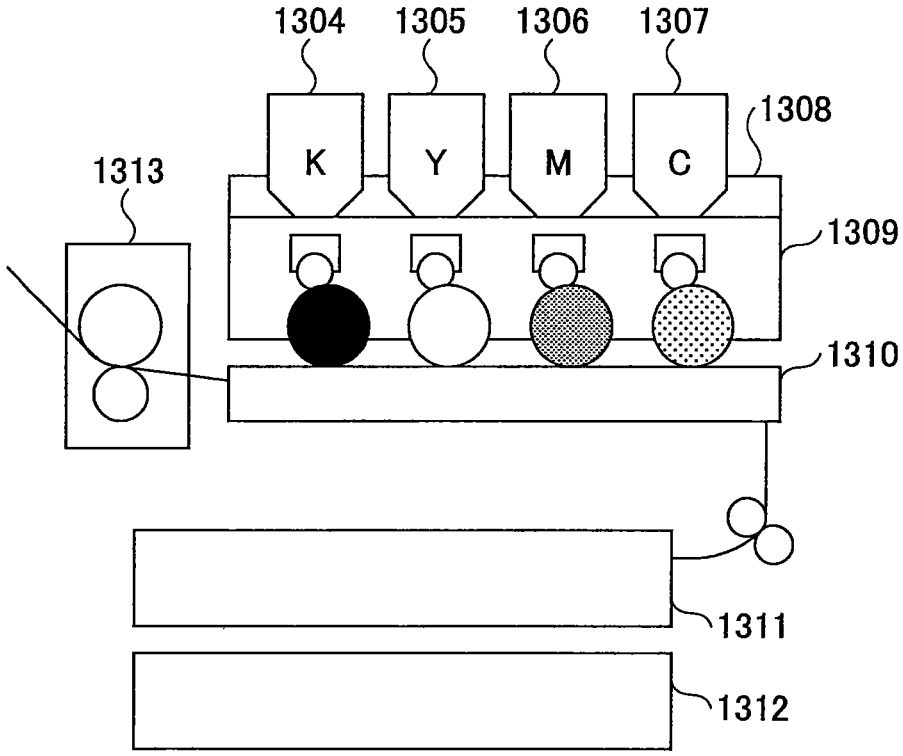
FIG. 4 is a diagram showing a part of a tandem-type color laser printer in which the electrophotographic process is used.

FIG. 2 is a diagram showing a flow of an electrophotographic process in the printer engine 13 shown in FIG. 1. FIG. 3 is a diagram in which an intermediate transfer belt is used in the electrophotographic process shown in FIG. 2. FIG. 4 is a diagram showing a part of a tandem-type color laser printer in which the electrophotographic process is used.

In FIG. 2, when processes from step S1 through S7 are applied to an organic photoconductor drum 1301 and a paper 1302, the image data input to the printer engine 13 are printed on the paper (recording medium) 1302.

Referring to FIG. 2, the above processes are described in detail.

First, negative electric charges are applied on the organic photoconductor drum 1302 (step S1).

Next, image data are exposed by removing the electric charges at parts where the image data do not exist by irradiating laser beams on the organic photoconductor drum 1301 based on the image data (step S2).

Next, the image data are developed by adhering positive toner to the electric charges remaining on the organic photoconductor drum 1301 (step S3).

Next, the paper 1302 is carried to the organic photoconductor drum 1301 on which the image data are developed and negative electric charges are applied from the paper 1302. With this, the toner adhered on the organic photoconductor drum 1301 is transferred onto the paper 1302 (step S4).

Next, an image is fixed on the paper 1302 by fixing the transferred toner on the paper 1302 (step S5).

Next, after transferring the toner onto the paper 1302, toner remaining on the organic photoconductor drum 1301 is removed by using a brush, a magnetic brush, or a blade, that is, the surface of the organic photoconductor drum 1301 is cleaned (step S6).

Next, the electric charges remaining on the organic photoconductor drum 1301 are discharged (erased) (step S7).

In FIG. 3, as an example, an intermediate transfer body is used when the toner is transferred from the organic photoconductor drum 1301 to the paper 1302.

As shown in FIG. 3, a first transfer step is executed by transferring the toner adhered on the organic photoconductor drum 1301 onto the intermediate transfer belt 1303. The toner transferred onto the intermediate transfer belt 1303 is transferred onto the paper 1302 by a second transfer step. The toner transferred onto the paper 1302 is fixed by a fixing step.

In the difference of the processes shown in FIG. 3 from the processes shown in FIG. 2, in FIG. 3, an intermediate transfer body is used, that is, the intermediate transfer belt 1303 is used. The first transfer step is similar to the steps S1 through S4, S6, and S7 shown in FIG. 2. The fixing step is similar to step S5 shown in FIG. 2. Therefore, the same description is omitted.

In FIG. 4, a tandem-type color laser printer is shown in which an electrophotographic process is applied to each color image of Y (yellow), M (magenta), C (cyan), and K (black).

A toner cartridge 1304 stores K toner, a toner cartridge 1305 stores Y toner, a toner cartridge 1306 stores M toner, and a toner cartridge 1307 stores C toner.

A writing optical unit 1308 forms a latent image by charging the surface of an organic photoconductor drum and exposing an image formed by laser beams irradiated onto the organic photoconductor drum 1301.

A developing unit 1309 develops the latent image by adhering toner to the latent image formed on the organic photoconductor drum 1301.

A transfer unit 1310 transfers the developed toner image onto the paper 1302. Paper feeding cassettes 1311 and 1322 store papers on which no image is printed.

A fixing unit 1313 fixes the toner image transferred onto the paper 1302.

Detection and Output of Consumed Status of Photoconductor Body

In the electrophotographic process, a charging process, an exposing process, a toner adhering process, an image transferring process, a cleaning process, and a discharging (erasing) process are applied to a photoconductor body. When the electrophotographic process is repeated, the surface of the photoconductor body is worn and marks of the wearing appear thereon, and this leads to lowering the optical conductivity. That is, the surface of the photoconductor body is degraded. The degradation leads to lowering the image quality, to excessively consuming toner, and to generating failures such as paper jamming. Therefore, when the wearing (consumed) status of the surface of the photoconductor body becomes a predetermined value or more, printing operations are restrained, for example, the printing operations are stopped, or information about the wearing status of the surface of the photoconductor body is output. With this, the user is requested to exchange the photoconductor body.

The information on the consumed status of the photoconductor body can be estimated from, for example, accumulated driving hours of a motor which drives the photoconductor body. When the accumulated driving hours of the motor are stored in the NV-RAM 11, even if the power source of the color laser printer 1 is turned off, the accumulated driving hours can be maintained. When the accumulated driving hours exceed a predetermined value, a message showing that the exchanging time will be soon is output. Further, when the accumulated driving hours exceed a predetermined value, a message showing that the exchanging time is right now is output, and the printing operations are stopped.

The accumulated driving hours of the motor can be converted into the number of printed papers by using a predetermined method. In the conversion, for example, an A4 size paper (210 mm×297 mm) is used and an image is printed on the A4 size paper in its long length direction. Then, the number of the printed A4 size papers is counted.

Detection and Output of Consumed Status of Toner

Toner is consumed by adhering onto a photoconductor body when a latent image is developed in the electrophotographic process. Further, when a developing unit is operated, since the toner is used as a buffer between the developing unit and the surface of the photoconductor body, a small amount of the toner is consumed regardless of image forming operations.

When the toner is used up, there is a risk that jamming may occur due to abnormal contact of the photoconductor body with a recording medium (paper) upon transferring an image onto the paper. In addition, when the toner as the buffer is used up, there is a risk that abnormal degradation of the surface of the photoconductor body may occur due to direct contact of the photoconductor body with the developing unit. In order to solve the above problems, re-supply of the toner is requested by the user based on detecting the remaining amount of toner.

Detection of the remaining amount of toner is executed by measuring the mass of the remaining toner in the apparatus, or is executed by detecting the upper surface of the toner in a toner container by a sensor. When it is determined that the toner container is full of toner as a reference, the remaining amount of the toner is detected at several intervals from full to vacancy. The intervals are determined, for example, every 5%, 10%, or 20% of full. When the remaining amount of the toner is smaller than a predetermined value, a message showing that toner must be re-supplied soon is output. When the remaining amount of the toner is further smaller than the predetermined value, a message is output showing that toner must be re-supplied right now or printing operations will be restricted or stopped.

When the remaining amount of the toner is output, supplying the toner can be easily executed.

Setting of Output of Consumed Status of Consumable Items

Figure 5:
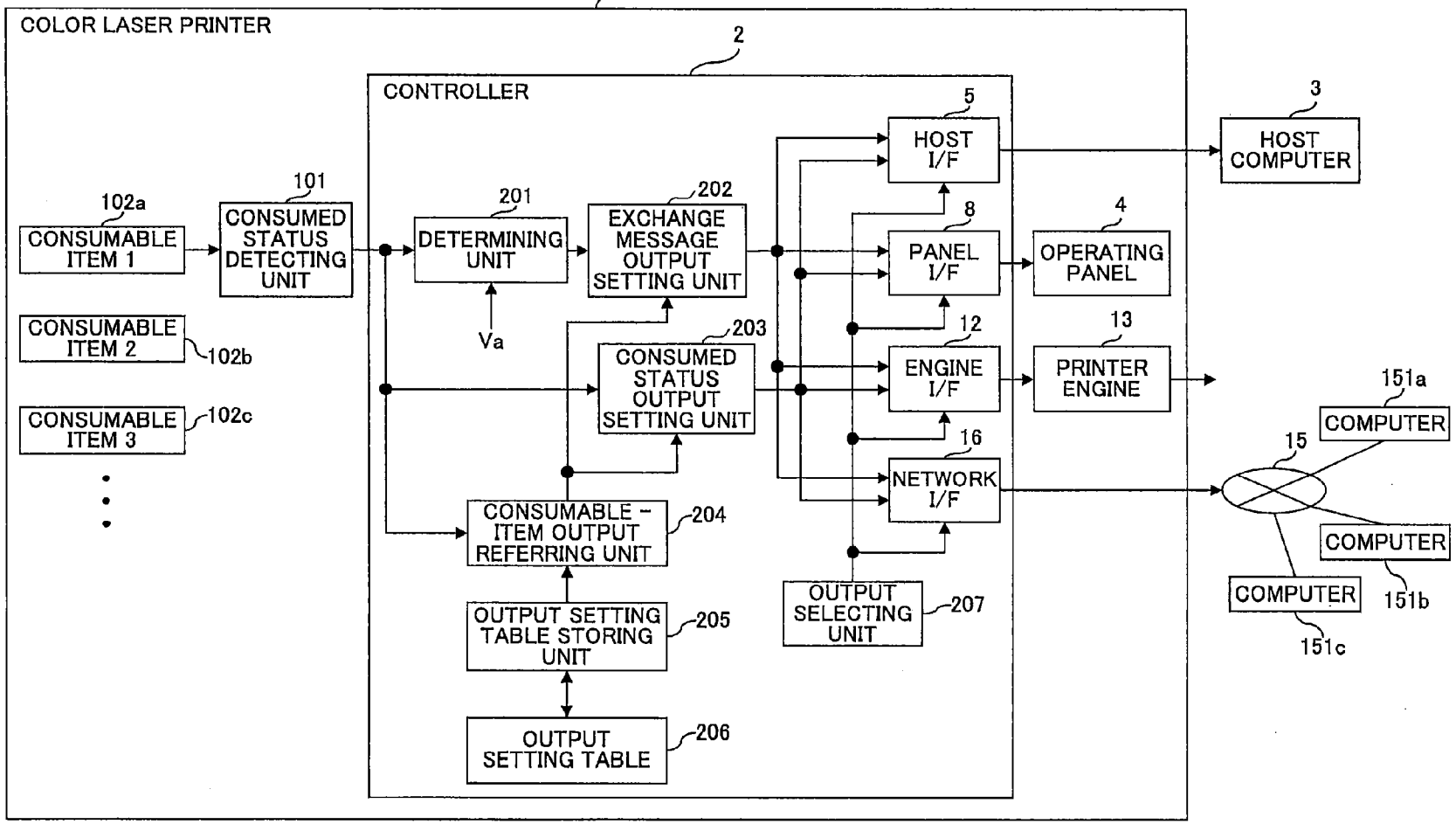
FIG. 5 is a block diagram showing the color laser printer shown in FIG. 1 in which an output setting table is used.

FIG. 5 is a block diagram showing the color laser printer 1 shown in FIG. 1 in which an output setting table is used. The output setting table is described below in detail.

As shown in FIG. 5, the color laser printer 1 includes the controller 2, the operating panel 4, the printer engine 13, a consumed status detecting unit 101, and consumable items 102*a* through 102*c*.

The controller 2 further includes a determining unit 201, an exchange message output setting unit 202, a consumed status output setting unit 203, a consumable-item output referring unit 204, an output setting table storing unit 205, an output setting table 206, and an output selecting unit 207. As described above, as the output I/Fs, the controller 2 includes the host I/F 5, the panel I/F 8, the engine I/F 12, and the network I/F 16. The output selecting unit 207 selects one of the output I/Fs.

The consumed status detecting unit 101 detects the consumed status of the consumable items 102*a* through 102*c*, and sends the name of the consumable item and a value indicating the consumed status to the determining unit 201. The name of the consumable item is also sent to the consumable-item output referring unit 204.

The determining unit 201 determines the consumed status of the consumable item by using a predetermined value Va which is determined for each consumable item, based on the value indicating the consumed status of the consumable item received from the consumed status detecting unit 101. For example, when the consumable item is a photoconductor body and the accumulated driving hours of the motor exceed a predetermined value, or when the consumable item is toner and the mass of the remaining toner is less than a predetermined value, the determining unit 201 sends a signal to the exchange message output setting unit 202 which signal requests to output an exchange message of the consumable item.

In addition, when plural exchange messages are set (prepositioned) for a consumable item, the determining unit 201 determines the consumed status of the consumable item by using predetermined values set for plural consumed status, and requests to output an exchange message corresponding to the value to the exchange message output setting unit 202.

When the exchange message output setting unit 202 receives the signal which requests to output an exchange message of the consumable item from the determining unit 201 and an output setting signal of the exchange message received from the consumable-item output referring unit 204 is "PRESENCE", the exchange message output setting unit 202 sets the output of the exchange message of the consumable item as "PRESENCE". Then the exchange message output setting unit 202 outputs the exchange message with the name thereof to the host I/F 5, the panel I/F 8, the engine I/F 12, or the network I/F 16.

When the output setting signal of the exchange message received from the consumable-item output referring unit 204 is "PRESENCE", the consumed status output setting unit 203 sets the output of the consumed status of the consumable item as "PRESENCE". Then, the consumed status output setting unit 203 outputs the exchange message with the name thereof and a value indicating the consumed status of the consumable item to the host I/F 5, the panel I/F 8, the engine I/F 12, or the network I/F 16.

The consumable-item output referring unit 204 selects "PRESENCE" or "NON-PRESENCE" of the output for each consumable item based on the name of the consumable item received from the consumed status detecting unit 101. Then, the consumable-item output referring unit 204 sends the selected one of "PRESENCE" or "NON-PRESENCE" to the exchange message output setting unit 202 and the consumed status output setting unit 203.

FIG. 6 is an output setting table in a case where there is a single exchange message. As shown in FIG. 6, in a photoconductor body, only the consumed status is output, and an exchange message is not output. In toner, both the consumed status and the exchange message are output.

FIG. 7 is an output setting table in a case where there are plural exchange messages. In FIG. 7, an exchange message 1 indicates that a consumable item must be exchanged right now (in some cases, hereinafter referred to as "END") and an exchange message 2 indicates that the exchange time will be soon (in some cases, hereinafter referred to as "NEAR END").

In the description, "message" includes not only a message by letters and numerals but also by signs.

The settings in the output setting tables shown in FIGS. 6 and 7 can be changed at any time by the manager or the user. The manager or the user instructs the consumable-item output referring unit 204 to change the setting from the host computer 3, the operating panel 4, or any one of the computers 151*a* through 151*c* via a connection route (not shown).

The output selecting unit 207 sets "PRESENCE" or "NON-PRESENCE" of the output of the exchange message and the consumed status in each I/F, regardless of the output from the consumable-item output referring unit 204. When the output from the output selecting unit 207 does not coincide with the outputs from the exchange message output setting unit 202 and the consumed status output setting unit 203, the output from the output selecting unit 207 is used as the higher priority.

Modified Example of Process in Consumable-Item Output Referring Unit

The consumable-item output referring unit 204 can select a combination of the consumable items in the output setting table which is stored in the output setting table storing unit 205.

FIG. 8 is a table showing combinations of output contents in the output setting table. In FIG. 8, four combinations A through D are shown. The consumable-item output referring unit 204 selects a combination in the four combinations.

The names of the combinations are not limited to the signs A through D, and can be modes such as "customer engineer mode", "user mode", "performance maintenance mode", and "normal maintenance mode" for the convenience of the manager or the user.

The combination of the consumable items can be changed at any time by the manager or the user. The manager or the user instructs the consumable-item output referring unit 204 to change the setting from the host computer 3, the operating panel 4, or any one of the computers 151*a* through 151*c* via a connection route (not shown).

Modified Example of Output Setting Table

Figure 9:
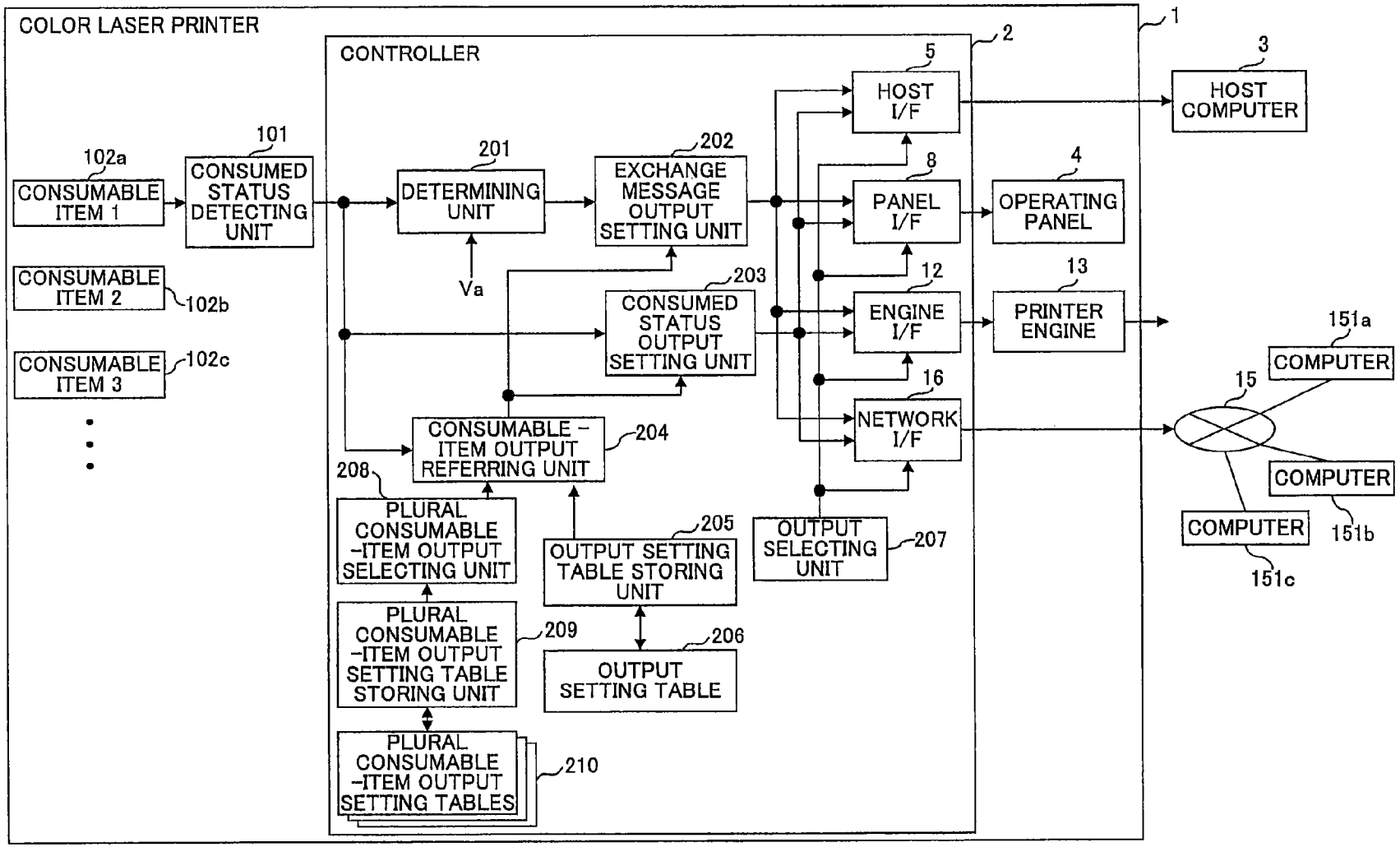
FIG. 9 is a block diagram showing the color laser printer shown in FIG. 1 in which a modified output setting table is used.

FIG. 9 is a block diagram showing the color laser printer 1 shown in FIG. 1 in which a modified output setting table is used. That is, in the modified output setting table, plural output setting tables are used.

As different points from those shown in FIG. 5, in FIG. 9, a plural consumable-item output selecting unit 208, a plural consumable-item output setting table storing unit 209, and plural consumable-item output setting tables 210 are newly added.

The plural consumable-item output selecting unit 208 selects one of the plural consumable-item output setting tables 210 stored in the plural consumable-item output setting table storing unit 209 based on an instruction of the manager or the user. Then, the plural consumable-item output selecting unit 208 sends the selected one of the plural consumable-item output setting tables to the consumable-item output referring unit 204.

The consumable-item output referring unit 204 selects a combination of output settings of a consumable item of a name received from the consumed status detecting unit 101 from the plural consumable-item output setting tables 210 selected by the plural consumable-item output selecting unit 208. Further, the consumable-item output referring unit 204 sends "PRESENCE" or "NON-PRESENCE" of the output contents to the exchange message output setting unit 202 and the consumed status output setting unit 203 in the selected combination of the output settings by referring to the output setting table 206 stored in the output setting table storing unit 205 for every output content.

When one of the plural consumable-item output setting tables 210 is selected, the manager or the user instructs the consumable-item output referring unit 204 from the host computer 3, the operating panel 4, or any one of the computers 151*a* through 151*c* via a connection route (not shown).

FIG. 10 shows examples of the plural consumable-item output setting tables 210. In FIG. 10, the combination name shown in FIG. 8 is used.

When the manager or the user selects the plural consumable-item output setting table shown in FIG. 10(*a*), the manager or the user can obtain the output contents of the consumable items in the selected table 210 at the same time. In FIG. 10(*a*), since the manager of both the photoconductor body and the toner is the user, the output contents shown in FIG. 7 are needed for the user.

In FIG. 10(*b*), a case is shown. In this case, the manager of the photoconductor body is not the user, and the manager of toner is the user. Therefore, with respect to the photoconductor body, only the exchange message 1 is needed for the user, and with respect to the toner, all of the output contents are needed for the user.

In FIG. 10(*c*), a case is shown. In this case, the manager of the photoconductor body and toner is not the user. Therefore, with respect to both the photoconductor body and the toner, only the exchange message 1 is needed for the user.

As described above, when the combination names are assigned as modes such as "customer engineer mode", "user mode", "performance maintenance mode", and "normal maintenance mode", the manger and the user can easily select one of the plural consumable-item output setting tables 210 by using one of the assigned modes.

Figure 11:
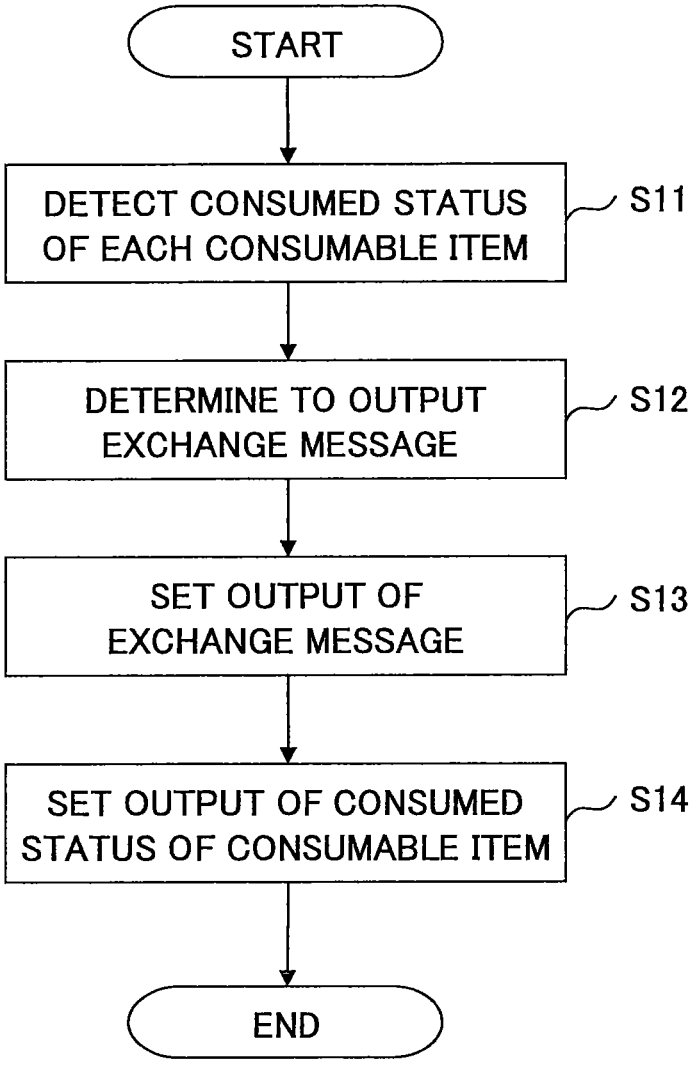
FIG. 11 is a flowchart showing processes to output information of a consumable item according to the embodiment of the present invention.

FIG. 11 is a flowchart showing processes to output information of a consumable item according to the embodiment of the present invention.

Referring to FIG. 11, the processes are described.

First, the consumed status detecting unit 101 detects the consumed status of each consumable item (step S11).

Next, the determining unit 201 determines whether an exchange message of the consumable item is to be output by comparing the consumed status of the consumable item detected by the consumed status detecting unit 101 with a predetermined value determined for each consumable item (step S12).

Next, when the determining unit 201 determines to output the exchange message of the consumable item, the exchange message output setting unit 202 sets an output of the exchange message of the consumable item (step S13).

Next, the consumed status output setting unit 203 sets an output of the consumed status of the consumable item detected by the consumed status detecting unit 101 (step S14).

In steps S13 and 14, with respect to "PRESENCE" or "NON-PRESENCE" in the output contents, the consumable-item output referring unit 204 can refer to the output setting table 206 stored in the output setting table storing unit 205.

When the processes in steps S11 through S14 are repeated, the outputs of the exchange message and the consumed status of each consumable item can be set corresponding to a change of the consumed status of the consumable item.

Figure 12:
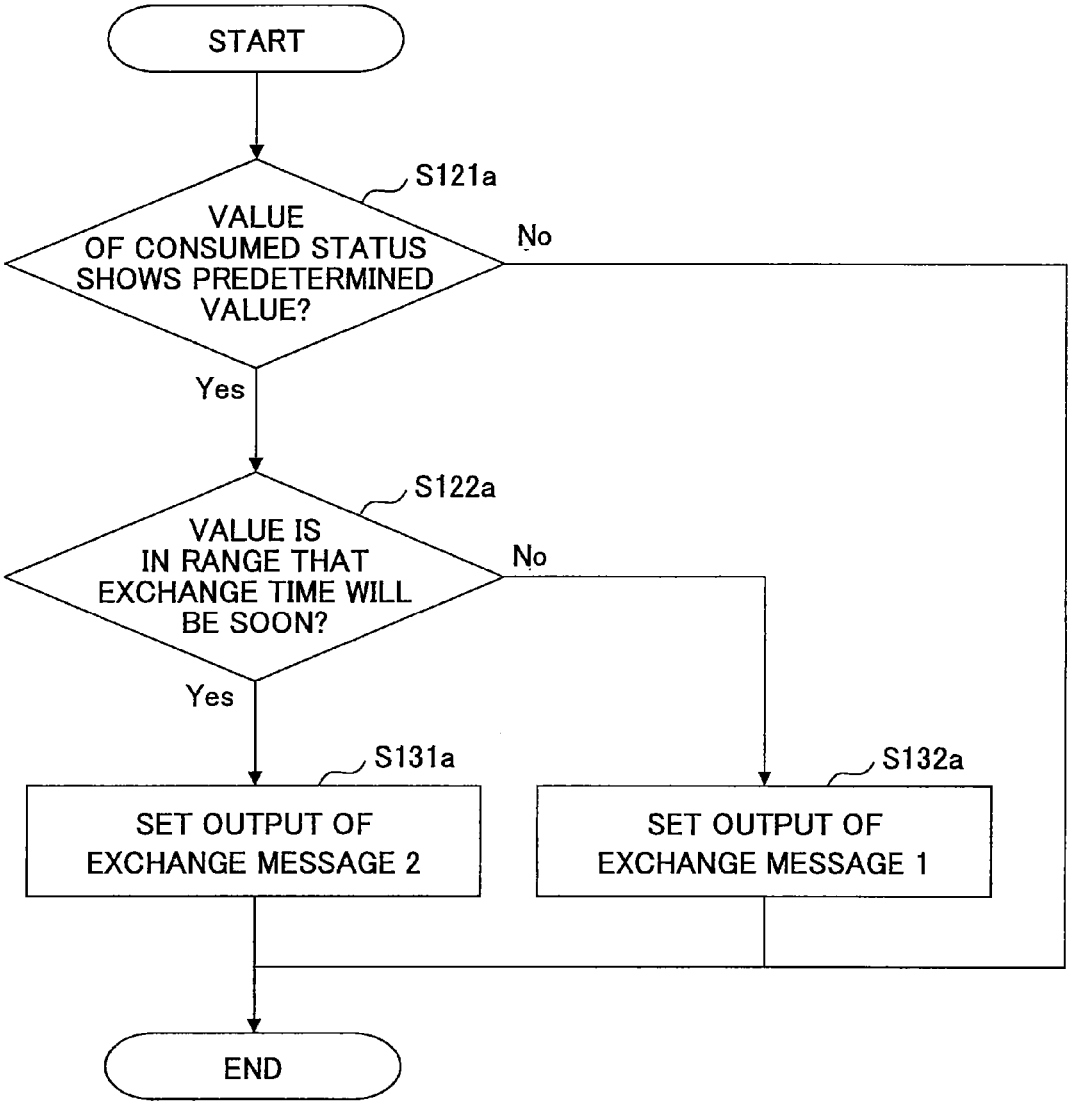
FIG. 12 is a flowchart showing processes to output information of a consumable item in a case where plural exchange messages exist corresponding to values of the consumed status of the consumable item according to the embodiment of the present invention.

FIG. 12 is a flowchart showing processes to output information of a consumable item in a case where plural exchange messages exist corresponding to values of the consumed status of the consumable item according to the embodiment of the present invention.

Referring to FIG. 12, the processes are described.

First, the determining unit 201 determines whether a value detected by the consumed status detecting unit 101 shows a predetermined value (step S121*a*). In this, when accumulated driving hours of a motor which drives the photoconductor body exceeds the predetermined value, the detected value shows the predetermined value, and when the mass of the remaining toner is less than a predetermined value, the detected value shows the predetermined value.

When the determining unit 201 determines that the consumed status value shows the predetermined value (YES in step S121*a*), the determining unit 201 further determines whether the consumed status value is in a range where the exchanging time will be soon (step S122*a*).

When the detected value is in the range where the exchanging time will be soon (YES in step S122*a*), the exchange message output setting unit 202 sets an output of the exchange message 2 (step S131*a*).

When the detected value is not in the range where the exchanging time will be soon (NO in step S122*a*), the exchange message output setting unit 202 sets an output of the exchange message 1 (step S132*a*).

Figures 13, 14:
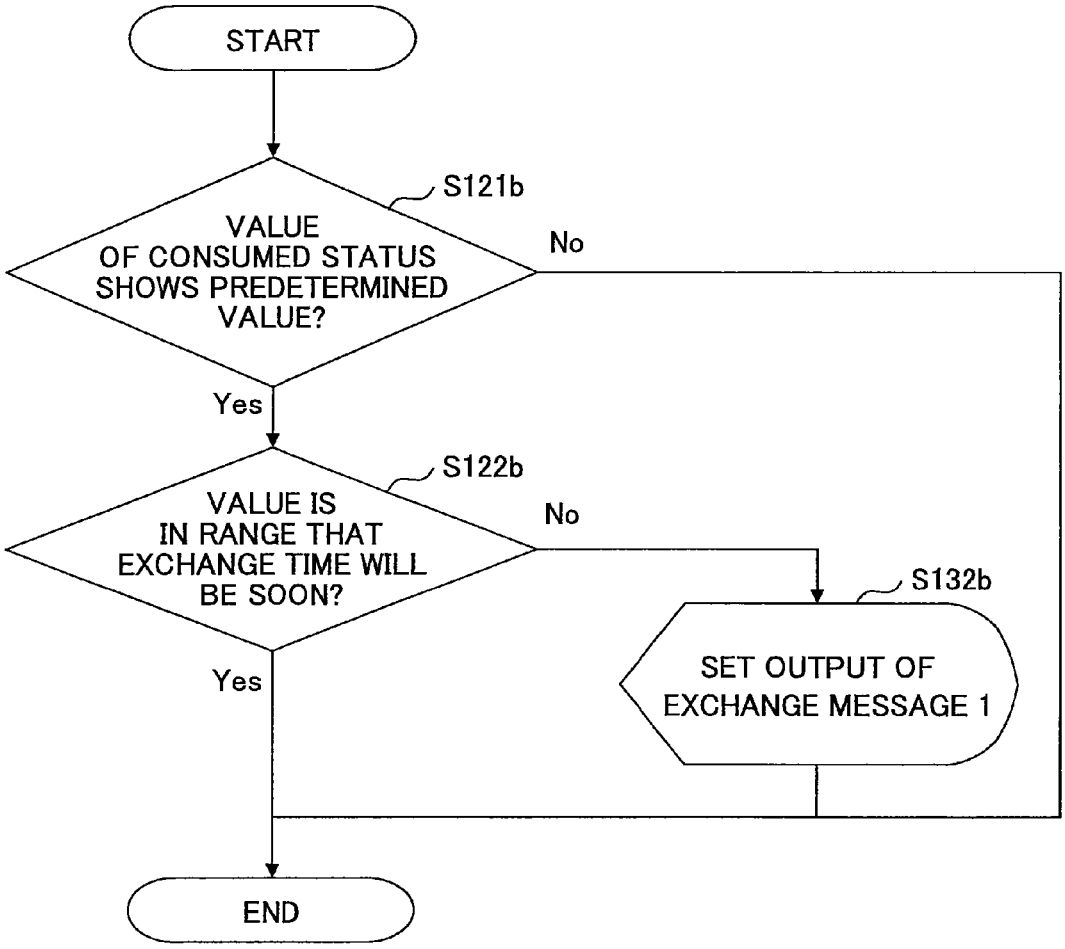
FIG. 13 is another flowchart showing processes to output information of a consumable item in a case where a single exchange message exists corresponding to a value of the consumed status of the consumable item according to the embodiment of the present invention.
FIG. 14 is a table showing "PRESENCE" and "NON-PRESENCE" of exchange messages to be output based on the consumed status of the consumable item.

FIG. 13 is another flowchart showing processes to output information of a consumable item in a case where a single exchange message exists corresponding to a value of the consumed status of the consumable item according to the embodiment of the present invention. FIG. 14 is a table showing "PRESENCE" and "NON-PRESENCE" of exchange messages to be output based on the consumed status of the consumable item.

Referring to FIGS. 13 and 14, the processes are described.

First, the determining unit 201 determines whether a value detected by the consumed status detecting unit 101 shows a predetermined value (step S121*b*). In this, when accumulated driving hours of a motor which drives the photoconductor body exceeds the predetermined value, the detected value shows the predetermined value, and when the mass of the remaining toner is less than a predetermined value, the detected value shows the predetermined value.

When the determining unit 201 determines that the detected value shows the predetermined value (YES in step S121*b*), the determining unit 201 further determines whether the detected value is in a range where the exchanging time will be soon (step S122*b*).

When the detected value is in the range where the exchanging time will be soon (YES in step S122*b*), since the exchange message 2 does not exist in the table shown in FIG. 14, the consumed status output setting unit 203 sets an output of the consumed status of the consumable item detected by the consumed status detecting unit 101 (step S14 of FIG. 11).

When the detected value is not in the range where the exchanging time will be soon (NO in step S122*b*), the exchange message output setting unit 202 sets an output of the exchange message 1 based on the table shown in FIG. 14, and outputs the exchange message 1 to the host I/F 5, the panel I/F 8, the engine I/F 12, or the network I/F 16 (step S132*b*).

Figure 15A:
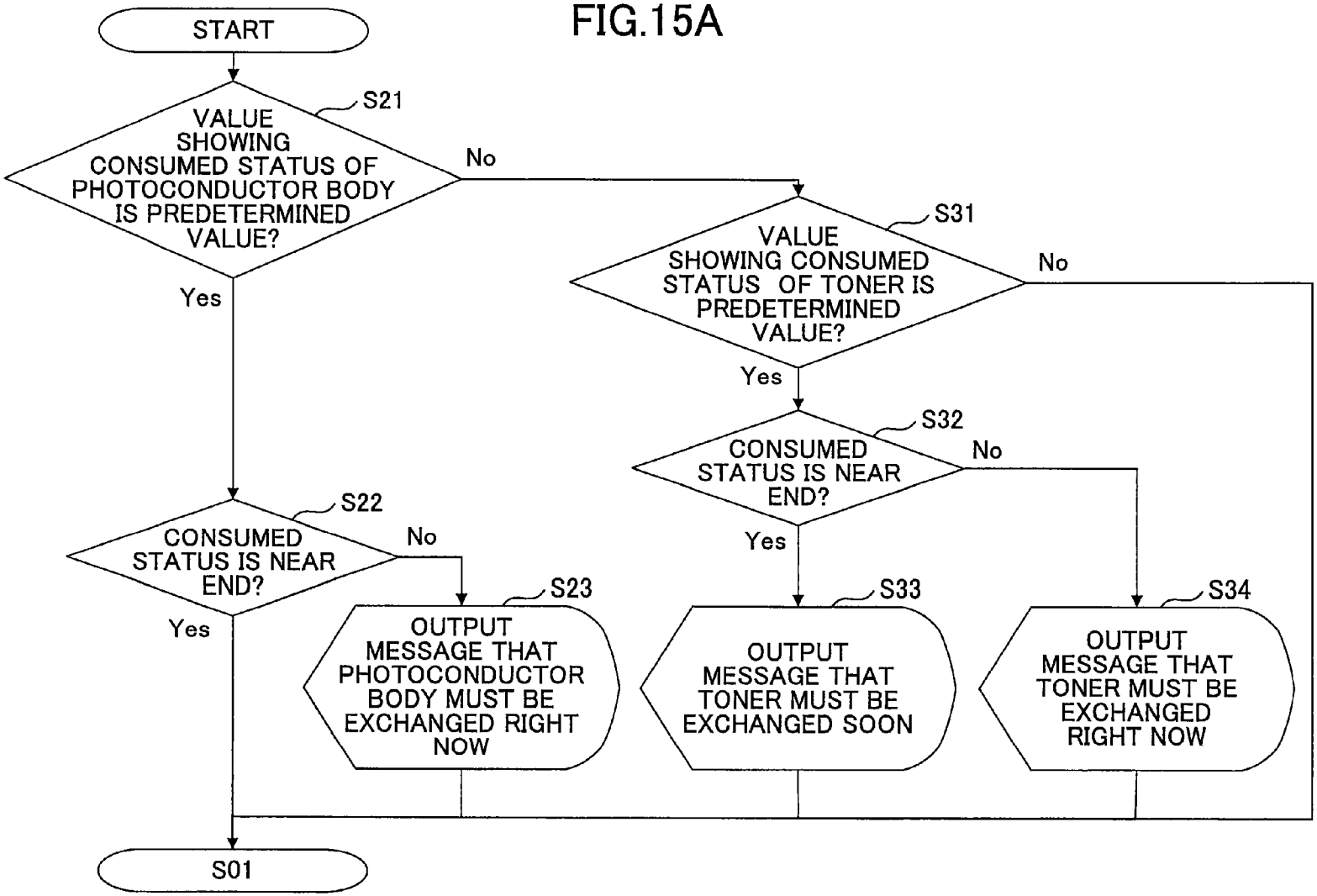
FIG. 15A is a flowchart showing processes for outputting exchange messages of consumable items according to the embodiment of the present invention.

FIG. 15A is a flowchart showing processes for outputting exchange messages of consumable items according to the embodiment of the present invention. In the processes, messages are output based on the table shown in FIG. 7.

First, the determining unit 201 determines whether a value showing the consumed status of a photoconductor body is a predetermined value (step S21).

When the determining unit 201 determines that the value showing the consumed status of the photoconductor body is the predetermined value (YES in step S21), the determining unit 201 further determines whether the consumed status is "NEAR END" (step S22). When the consumed status is "NEAR END" (YES in step S22), the process goes to step S01 (described below). When the consumed status is not "NEAR END" (NO in step S22), that is, the consumed status is "END", the exchange message output setting unit 202 sets to output a message that the photoconductor body must be exchanged right now and outputs the message to the host I/F 5, the panel I/F 8, the engine I/F 12, or the network I/F 16 (step S23).

Next, when the determining unit 201 determines that the value showing the consumed status of the photoconductor body is not the predetermined value (NO in step S21), the determining unit 201 further determines whether a value showing the consumed status of toner is a predetermined value (step S31).

When the value showing the consumed status of the toner is the predetermined value (YES in step S31), the determining unit 201 determines whether the consumed status is "NEAR END" (step S32). When the consumed status is "NEAR END" (YES in step S32), the exchange message output setting unit 202 sets to output a message that the toner must be exchanged soon and outputs the message (message 2) to the host I/F 5, the panel I/F 8, the engine I/F 12, or the network I/F 16 (step S33).

When the consumed status is not "NEAR END" (NO in step S32), that is, the consumed status is "END", the exchange message output setting unit 202 sets to output a message that the toner must be exchanged right now and outputs the message (message 1) to the host I/F 5, the panel I/F 8, the engine I/F 12, or the network I/F 16 (step S34).

Figure 15B:
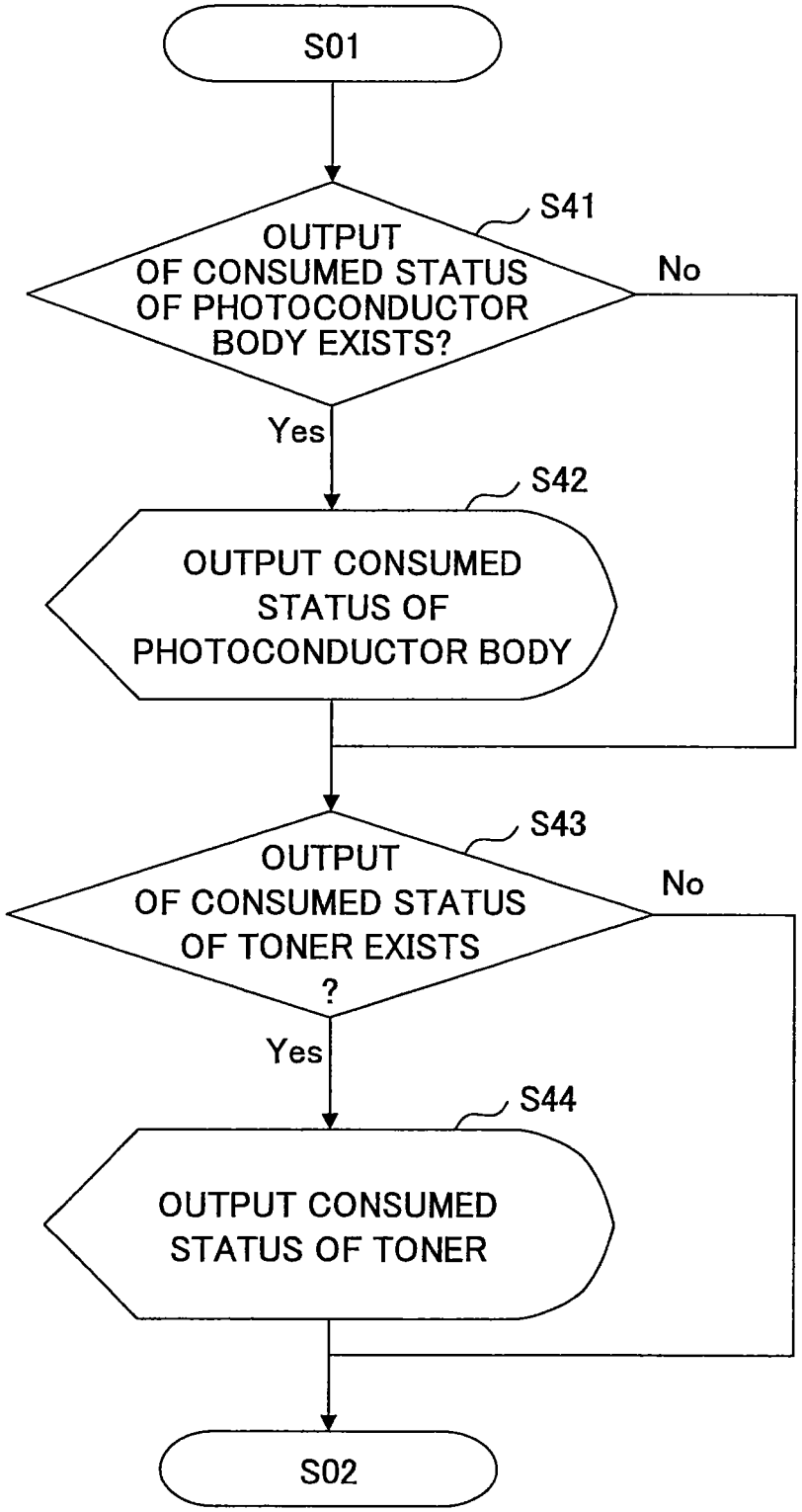
FIG. 15B is a flowchart showing processes for outputting the consumed status of consumable items according to the embodiment of the present invention.

FIG. 15B is a flowchart showing processes for outputting the consumed status of consumable items according to the embodiment of the present invention. That is, in FIG. 15B, the process starts from step S01 shown in FIG. 15A.

First, the consumed status output setting unit 203 sets to output the consumed status of the photoconductor body, and when the output of the consumed status of the photoconductor body exists (YES in step S41), the consumed status output setting unit 203 outputs the consumed status of the photoconductor body to the host I/F 5, the panel I/F 8, the engine I/F 12, or the network I/F 16 (step S42).

Next, when the output of the consumed status of the photoconductor body does not exist (NO in step S41), the consumed status output setting unit 203 sets to output the consumed status of toner, and when the output of the consumed status of the toner exists (YES in step S43), the consumed status output setting unit 203 outputs the consumed status of the toner to the host I/F 5, the panel I/F 8, the engine I/F 12, or the network I/F 16 (step S44).

When the output of the consumed status of the toner does not exist (NO in step S43), the process goes to step S02 (described below).

Setting conditions of the outputs in steps S41 and 43 can be arbitrarily changed by the manager or the user by using the input I/F such as the operating panel 4.

Figure 15C:
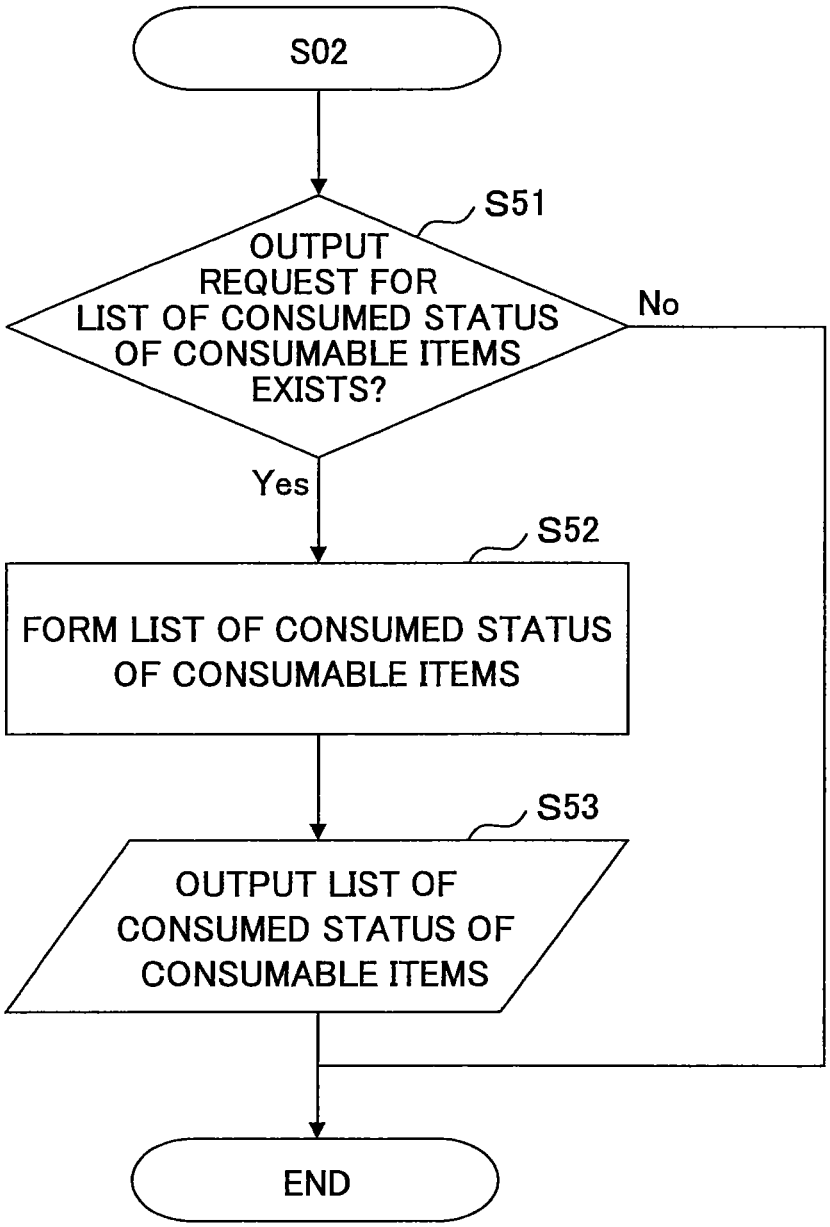
FIG. 15C is a flowchart showing processes for outputting a list of the consumed status of consumable items according to the embodiment of the present invention.

FIG. 15C is a flowchart showing processes for outputting a list of the consumed status of consumable items according to the embodiment of the present invention. That is, in FIG. 15C, the process starts from step S02 shown in FIG. 15B.

First, it is determined whether an output request for the list of the consumed status of the consumable items exists (step S51).

Next, the consumed status output setting unit 203 sets an output of the consumed status of the consumable items based on an output of each consumable item which is referred to by the consumable-item output referring unit 204. At the same time, the determining unit 201 compares a value showing the consumed status of each consumable item with a predetermined value, and the exchange message output setting unit 202 sets an output of a message regarding the consumed status, based on the determination of the determining unit 201 and the output of each consumable item which is referred to by the consumable-item output referring unit 204.

Based on the determined output of the consumed status and the output of the message regarding the consumed status, a list of the consumed status of the consumable items is formed (step S52).

Next, the engine I/F 12 outputs the formed list of the consumed status of the consumable items to the printer engine 13 (step S53). The printer engine 13 prints the list of the consumed status of the consumable items on a recording medium and outputs the printed list.

Figure 16:
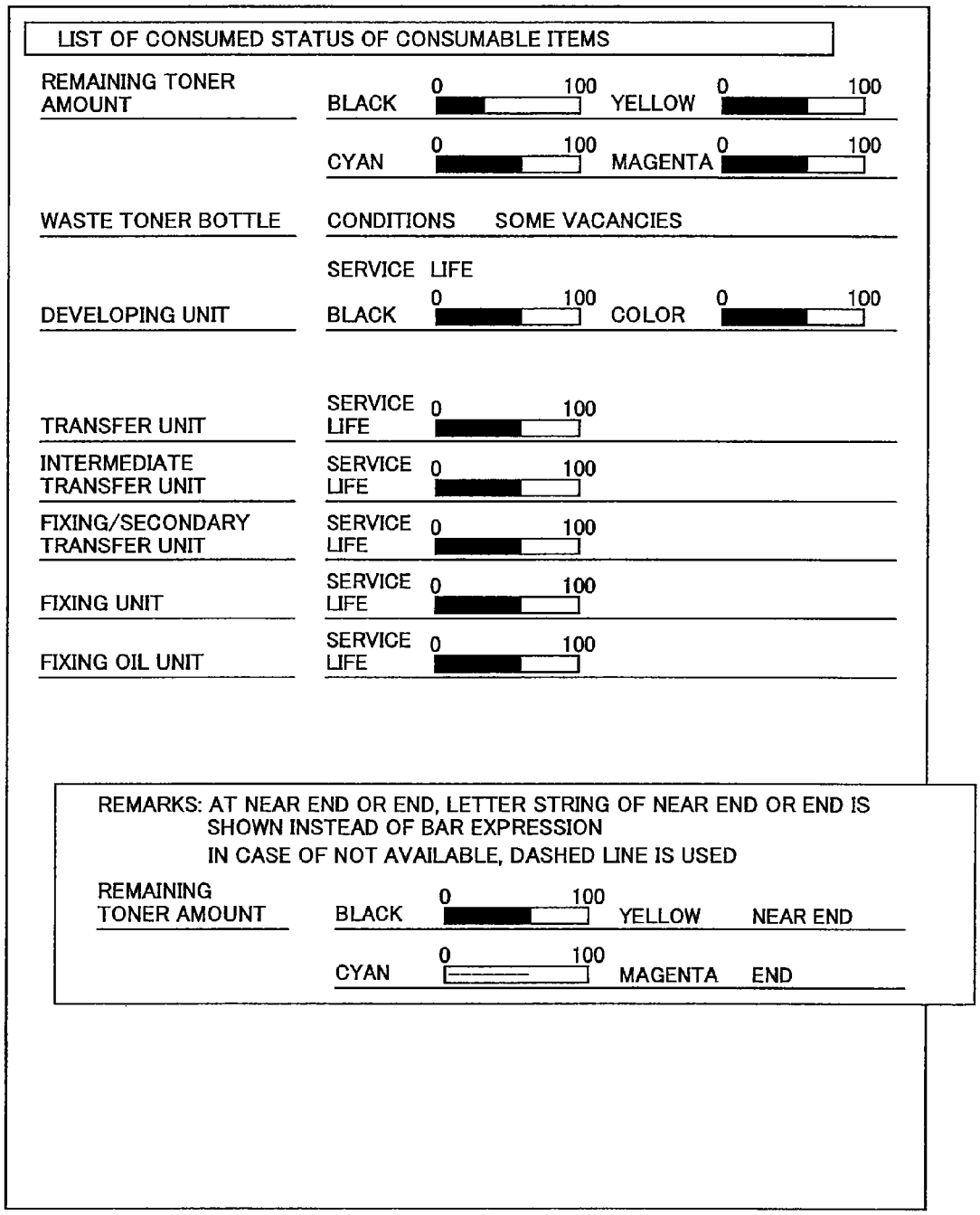
FIG. 16 is a list of the consumed status of consumable items according to the embodiment of the present invention.

FIG. 16 is a list of the consumed status of consumable items according to the embodiment of the present invention. In FIG. 16, an example of a normal maintenance system is shown.

In FIG. 16, the remaining toner amount of each color, conditions of a waste toner bottle, and the remaining service life of each developing unit, a transfer unit, an intermediate transfer unit, a fixing/secondary transfer unit, a fixing unit, and a fixing oil unit are printed on a paper.

In addition, the remaining amount (consumed status) of each consumable item is shown by the length of a bar having intervals. When the consumed status becomes "NEAR END" or "END", a letter string of "NEAR END" or "END" is used instead of the bar, and when the consumed status is not available, a dashed line is used instead of the bar.

FIG. 17 is a table in which remaining amount information of each consumable item is shown. As shown in FIG. 17, toner can be displayed in two expressions of black and color, or in four expressions of black, yellow, cyan, and magenta. The remaining amount of the toner is expressed at intervals of 10% or 20%. In addition, when the exchange time of toner will be soon, the letter string "NEAR END" is displayed (printed), and when the toner must be exchanged right now, the letter string "END" is displayed (printed).

In the case of a waste toner bottle, the remaining amount information is displayed (printed) in three steps, some vacancy, NEAR END, and full.

In case of the developing units, the transfer unit, the intermediate transfer unit, the fixing and secondary transfer unit, the fixing unit, and the fixing oil unit, the manager can determine whether the consumed status thereof is to be output for the user. Since the user does not exchange the above items, it is enough that the manager can obtain the information. In addition, the display (printing) of each of the developing units, the transfer unit, the intermediate transfer unit, the fixing and secondary transfer unit, the fixing unit, and the fixing oil unit can be turned on/off in the customer engineer system.

The table shown in FIG. 17 is an example, and the consumed items of the table are different among apparatuses. In addition, the intervals in the remaining amount information can be set arbitrarily.

In the remaining amount information, at 10% intervals, for example, when the remaining amount is 1% to 10%, the bar is at the 10% point. The concept is the same as at 20% intervals. In addition, in the remaining amount information, when the remaining amount becomes 0%, "END" is displayed, and becomes almost 0%, "NEAR END" is displayed.

Figure 18:
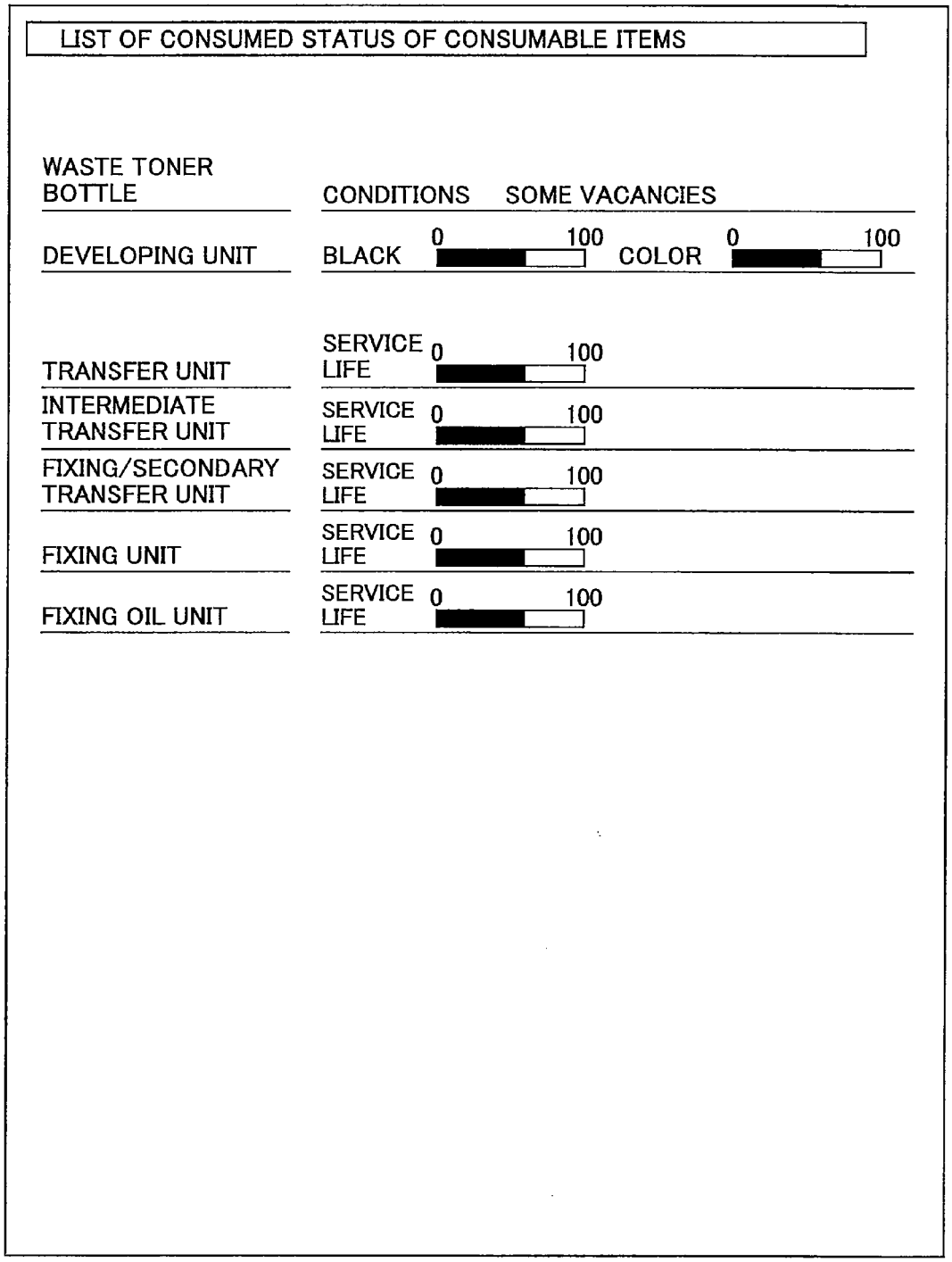
FIG. 18 is another list of the consumed status of consumable items according to the embodiment of the present invention.

FIG. 18 is another list of the consumed status of consumable items according to the embodiment of the present invention. In FIG. 18, an example of a performance maintenance system is shown. In this case, since the toner is exchanged by the user, the toner is not displayed.

Further, the present invention is not limited to the specifically disclosed embodiment, and variations and modifications may be made without departing from the scope of the present invention.

What is claimed is:

1. An apparatus that uses plural kinds of consumable items different from each other, the apparatus comprising:

a consumption status detecting unit configured to detect a respective consumption status for each of the plural kinds of the consumable items;

a memory configured to store a plurality of settings for each of the plural kinds of the consumable items, each of the settings including presence or non-presence of information output; and an output unit configured to output the consumption status detected by the consumption status detecting unit, according to the setting of the presence or the non-presence of information output stored in the memory.

2. The apparatus of claim 1, wherein the memory stores a plurality of tables, each of the tables storing the settings including the presence or the non-presence of information output for each of the plural kinds of the consumable items;

the apparatus further comprises a selecting unit configured to select one table of the plurality of tables; and the output unit outputs the consumption status based on the table selected by the selecting unit.

3. The apparatus of claim 2, wherein the selecting unit selects the one table based on an instruction by a user or a manager.

4. The apparatus of claim 1, further comprising:

a consumable-item output referring unit configured to receive an instruction from a manager or user to select one of the plurality of settings in the memory.

5. The apparatus of claim 1, wherein the output unit is configured to output the consumption status to a destination.

6. The apparatus of claim 5, wherein the destination is a display of the apparatus.

7. The apparatus of claim 5, wherein the destination is an external medium of the apparatus.

8. A method for an apparatus that uses plural kinds of consumable items different from each other, the method comprising:

detecting a respective consumption status for each of the plural kinds of the consumable items;

storing, in memory, a plurality of settings for each of the plural kinds of the consumable items, each of the settings including presence or non-presence of information output; and outputting the detected consumption status according to the setting of the presence or the non-presence of information output stored in the memory.

9. The method of claim 8, further comprising:

storing, in the memory, a plurality of tables, each of the tables storing the settings including the presence or the non-presence of information output for each of the plural kinds of the consumable items;

selecting one table of the plurality of tables; and outputting the consumption status based on the table selected in the selecting step.

10. The method of claim 9, wherein the selecting step comprises selecting the one table based on an instruction from a user or a manager.

11. The method of claim 8, further comprising:

receiving an instruction from a manager or user to select one of the plurality of settings in the memory.

12. The method of claim 8, wherein the outputting step includes outputting the consumption status to a destination.

13. The method of claim 12, wherein the destination is a display of the apparatus.

14. The method of claim 12, wherein the destination is an external medium of the apparatus.

* * * * *